US009308421B2

(12) United States Patent
Ban et al.

(10) Patent No.: US 9,308,421 B2
(45) Date of Patent: Apr. 12, 2016

(54) GOLF CLUB HEAD

(71) Applicant: BRIDGESTONE SPORTS CO., LTD., Minato-ku, Tokyo (JP)

(72) Inventors: Wataru Ban, Chichibu (JP); Atsushi Komatsu, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 35 days.

(21) Appl. No.: 14/457,744

(22) Filed: Aug. 12, 2014

(65) Prior Publication Data

US 2015/0133234 A1 May 14, 2015

(30) Foreign Application Priority Data

Nov. 8, 2013 (JP) ..... 2013-232566

(51) Int. Cl.
*A63B 53/04* (2015.01)

(52) U.S. Cl.
CPC ..... *A63B 53/04* (2013.01); *A63B 53/0466* (2013.01); *A63B 2053/0408* (2013.01); *A63B 2053/0445* (2013.01)

(58) Field of Classification Search
CPC ..... A63B 53/04
See application file for complete search history.

(56) References Cited

U.S. PATENT DOCUMENTS

| | | | | |
|---|---|---|---|---|
| 7,641,570 | B2 | 1/2010 | Yokota | |
| 2008/0293511 | A1 * | 11/2008 | Gilbert | A63B 53/04 473/331 |
| 2013/0288820 | A1 * | 10/2013 | Shimahara | A63B 53/04 473/331 |

FOREIGN PATENT DOCUMENTS

| | | | |
|---|---|---|---|
| JP | 2008-079969 | A | 4/2008 |
| JP | 2008-259582 | A | 10/2008 |

* cited by examiner

*Primary Examiner* — Michael Dennis
(74) *Attorney, Agent, or Firm* — Sughrue Mion, PLLC

(57) ABSTRACT

A golf club head of this invention includes a sole portion and a face portion. The golf club head includes a metal member that forms the face portion. The surface of the metal member includes a plurality of score lines, and undulations continuously formed in the up-down direction of the face portion. The pitch between adjacent apexes of the undulations exceeds 3 mm. The score lines are formed at the apexes of the undulations.

15 Claims, 8 Drawing Sheets

FIG. 8A
| | PITCH P (mm) | HEIGHT H (mm) | SPIN AMOUNT (rpm) |
|---|---|---|---|
| #1 | – | | 3208 |
| #2 | 3 | 2 | 3225 |
| #3 | 5 | | 3062 |
| #4 | 7 | | 3184 |
FIG. 8C
| | PITCH P (mm) | HEIGHT H (mm) | SPIN AMOUNT (rpm) |
|---|---|---|---|
| #11 | – | | 3252 |
| #12 | 5 | 0.25 | 3251 |
| #13 | | 0.50 | 3237 |
| #14 | | 1.00 | 3200 |
| #15 | | 2.00 | 3139 |
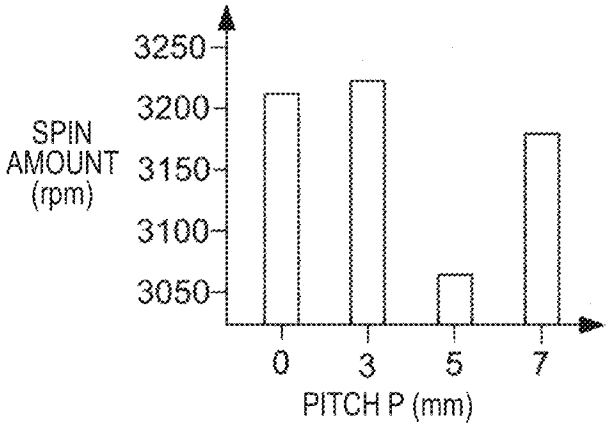
FIG. 8B
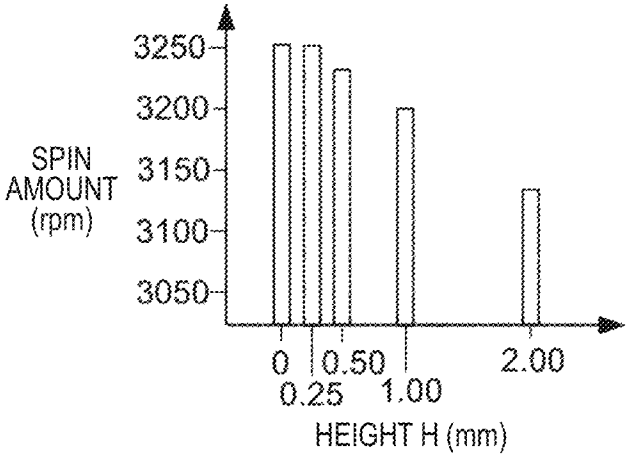
FIG. 8D

GOLF CLUB HEAD

BACKGROUND OF THE INVENTION

1. Field of the Invention

The present invention relates to a golf club head.

2. Description of the Related Art

To increase the distance of a shot, the back spin amount is preferably small. The back spin amount is associated with the structure of a face portion. Japanese Patent Laid-Open No. 2008-259582 discloses a face portion shape that has projections between score lines to reduce the back spin amount. Japanese Patent Laid-Open No. 2008-79969 discloses a golf club head that places focus on the fact that the back spin amount decreases as the friction between a ball and a face portion becomes high in a golf club having a small loft angle.

To make the friction high between the face portion and the ball, a method of roughening the face portion by milling or shot blast is considerable. However, when simply roughened, the face portion readily damages balls, although the friction coefficient becomes high.

SUMMARY OF THE INVENTION

It is an object of the present invention to increase the friction between a face portion and a ball while suppressing damage to the ball.

According to the present invention, for example, there is provided a golf club head including a sole portion and a face portion, comprising a metal member that forms the face portion, wherein a surface of the metal member comprises a plurality of score lines, and undulations continuously formed in an up-down direction of the face portion, a pitch between adjacent apexes of the undulations exceeds 3 mm, and the score lines are formed at the apexes of the undulations.

Further features of the present invention will become apparent from the following description of exemplary embodiments (with reference to the attached drawings).

BRIEF DESCRIPTION OF THE DRAWINGS

FIGS. 8A to 8D are views showing experimental results.

DESCRIPTION OF THE EMBODIMENTS

Figure 1A:
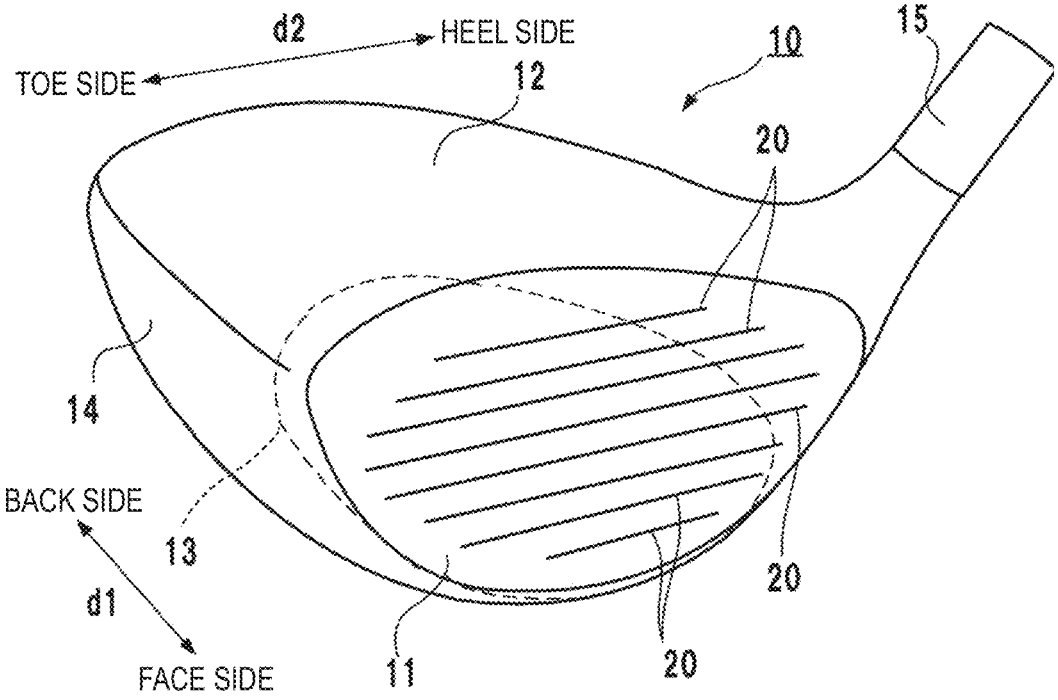
FIG. 1A is a perspective view of a golf club head according to an embodiment of the present invention.
Figure 1B:
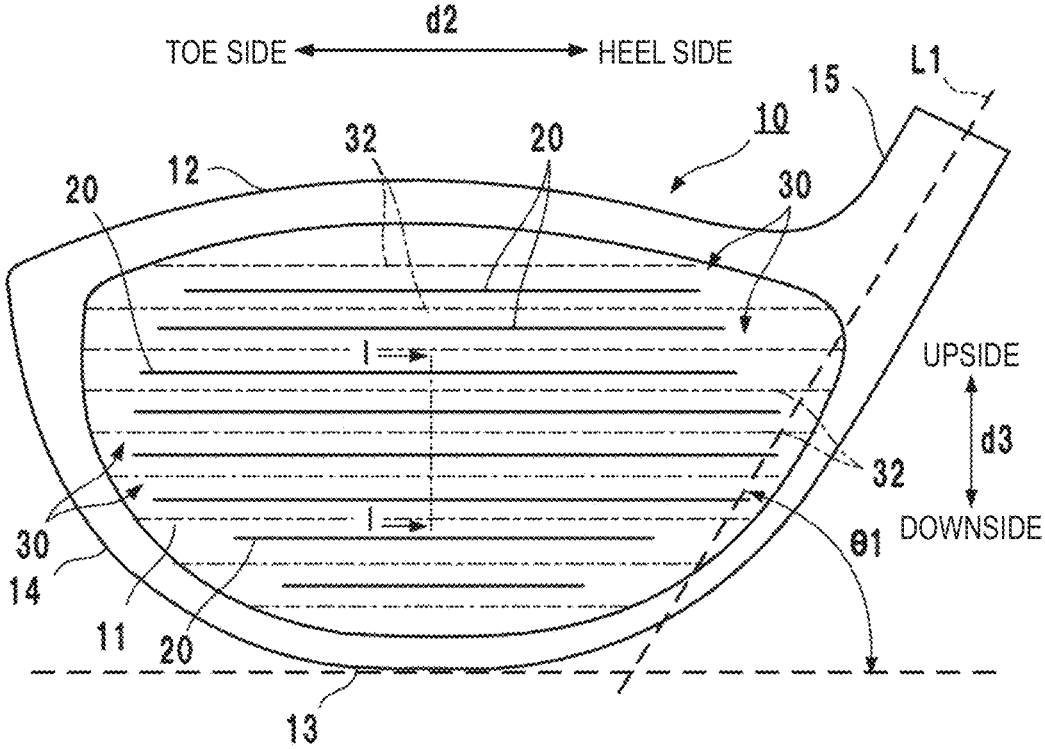
FIG. 1B is a front view showing the golf club head shown in FIG. 1A viewed from a face side.

FIG. 1A is a perspective view of a golf club head 10 according to an embodiment of the present invention. FIG. 1B is a front view of the golf club head 10 viewed from the side of a face portion 11.

The golf club head 10 has a hollow body. The peripheral walls construct the face portion 11 that forms the face (striking face), a crown portion 12 that forms the upper portion of the golf club head 10, a sole portion 13 that forms the bottom portion of the golf club head 10, and a side portion 14 between the crown portion 12 and the sole portion 13. The golf club head 10 also includes a hosel portion 15 to which a shaft is attached.

An arrow d1 in FIG. 1A indicates the face-back direction, and an arrow d2 indicates the toe-heel direction. An arrow d3 in FIG. 1B indicates the up-down direction of the face portion 11. The face-back direction is normally a target line direction (target direction of a shot). The toe-heel direction is the direction connecting the toe-side end and the heel-side end of the sole portion 13. The up-down direction of the face portion 11 is defined in a state in which the golf club head is in contact with the ground at a predetermined lie angle. In this embodiment, the up-down direction is the direction of the sole portion 13 and the crown portion 12. Note that the lie angle is an angle θ1 made by a shaft axis L1 and the ground surface, as shown in FIG. 1B.

The golf club head 10 is a golf club head for a driver. However, the present invention is applicable to various kinds of golf club heads including a face portion and a sole portion, for example, wood type golf club heads including a fairway wood, utility type (hybrid type) golf club heads, other hollow golf club heads, and iron type golf club heads in addition to drivers. The present invention is especially suitable for a golf club head having a loft angle of 20° or less.

The golf club head 10 can be made of a metal material. Examples of the metal material are titanium-based metals (for example, titanium alloy 6A1-4V-Ti), stainless steel, and copper alloys such as beryllium copper.

The golf club head 10 can be assembled by joining a plurality of parts. For example, the golf club head 10 can be formed from a main body member and a face member. The main body member constructs the crown portion 12, the sole portion 13, the side portion 14, and the edge portion of the face portion 11. An opening is formed partially in a portion corresponding to the face portion 11. The face member is joined to the opening of the main body member.

Figure 2A:
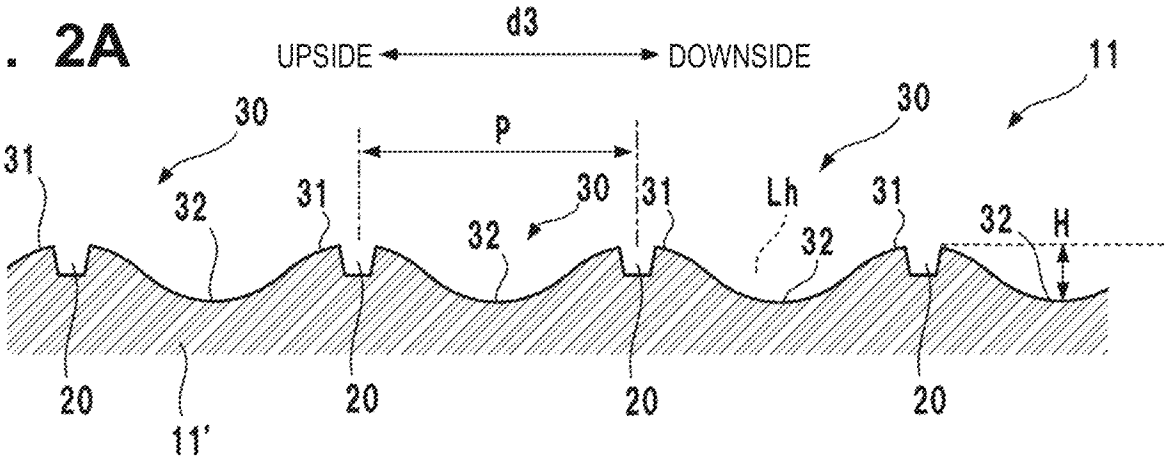
FIG. 2A is a sectional view taken along a line I-I in FIG. 1B.

The face portion 11 has a plurality of score lines 20 and a plurality of undulations 30. The undulations 30 form an undulating surface in the face portion 11. The undulating surface continuously undulates in an up-down direction of the face portion 11. The score lines 20 and the undulations 30 will be described with reference to FIG. 2A in addition to FIGS. 1A and 1B. FIG. 2A is a sectional view taken along a line I-I in FIG. 1B.

The score lines 20 and the undulations 30 are formed on the surface of a metal member 11' that forms the face portion 11.

The score lines 20 are grooves extending in the toe-heel direction. The score lines 20 are parallel to each other. In this embodiment, the score lines 20 are formed into a line shape without a break. However, the score lines 20 may break at a midway portion (for example, the center of the face portion 11). The score lines 20 are formed at an equal pitch. However, the pitch may change.

Each undulation 30 includes one projecting portion 31 and one bottom portion 32. The projecting portions 31 and the bottom portions 32 extend in parallel to the score lines 20. That is, the undulations 30 extend in the toe-heel direction. The plurality of undulations 30 are periodically continuously formed in the up-down direction of the face portion 11. Hence, when the face portion 11 is observed in the up-down direction, the projecting portions 31 and the bottom portions 32 are alternately repeated.

The plurality of undulations 30 are formed all over the face portion 11. However, the undulations 30 may be formed only in part of the face portion 11. For example, the plurality of undulations 30 may be formed only in the impact area. In driving clubs and fairway woods, the impact area is defined under the rules as a band-shaped portion passing through the club face center and having a width of 1.68 inches (42.67 mm). In iron clubs, the impact area is defined as a larger one of a club portion having undergone face processing (for example, grooving, sand blast, or the like) and a band-shaped portion passing through the club face center and having a width of 1.68 inches (42.67 mm).

A height H indicates the height from the bottom portion 32 (deepest point) to the apex (apex of the projecting portion 31) of the undulation 30. The height H is preferably 0.5 mm (inclusive) to 2 mm (inclusive). If the height H is less than 0.5 mm, the back spin amount reducing effect may be weak. If the height H exceeds 2 mm, the contact area between a ball and the face portion 11 does not so greatly increase, and the back spin amount reducing effect may not be enhanced any more. In addition, the manufacture is difficult in some cases.

In this embodiment, the sectional contour of the undulation 30 has an S shape and, in particular, a sine wave shape. When the sectional contour of the undulation 30 has the S shape, the surface of the ball deforms in conformity with the undulations 30 at impact. The contact area between the ball and the face portion 11 increases, and the back spin amount reducing effect is enhanced. Damage to the ball can also be prevented. In the sine wave shape, the projecting portions 31 and the bottom portions 32 form a moderate symmetrical curve. This can further prevent damage to the ball.

A pitch P indicates the distance between adjacent apexes (between the projecting portions 31). When the pitch P is too short, the back spin amount reducing effect may be weak. Hence, the pitch P preferably exceeds 3 mm. In particular, the pitch P is preferably 5 mm (inclusive) to 7 mm (inclusive). When the pitch P exceeds 7 mm, the influence of the difference in the position of the impact point may become large.

The score lines 20 are formed in the projecting portions 31. When the score lines 20 are formed in the projecting portions 31, the score lines 20 readily come into contact with the ball. In this embodiment, especially, the score lines 20 are formed at the apexes of the projecting portions 31. This facilitates uniforming the widths and depths of the score lines 20.

In this embodiment, the score lines 20 are formed in the projecting portions 31. Hence, the pitch P equals the arrangement pitch of the score lines 20. Only one bottom portion 32 is formed between adjacent score lines 20. Since the score lines 20 and the undulations 30 are regularly formed, a uniform frictional force can be given to the ball independently of the position of the impact point.

The score lines 20 and the undulations 30 can be formed by, for example, machining using a cutting tool, forging, or casting.

In the golf club head 10 having the above-described arrangement, the ball hardly slides over the face portion 11 at impact because the existence of the plurality of undulations 30. As a result, the same effect as in roughening can be obtained without roughening the surface of the face portion 11 by milling or shot blast. As already described, in a golf club having a small loft angle, for example, in a golf club head having a loft angle of 20° or less, the back spin amount decreases as the friction between the ball and the face portion becomes high.

Hence, according to the golf club head 10 of this embodiment, the back spin amount of the ball can be reduced by the existence of the plurality of undulations 30. In addition, since roughening by milling or shot blast is unnecessary, damage to the ball can be prevented. To prevent damage to the ball, the surface of the face portion 11 is preferably smooth. For example, an arithmetic surface roughness Ra of the face portion 11 is preferably 4 μm or less.

OTHER EXAMPLES OF SCORE LINES AND UNDULATIONS

Other examples of the score lines 20 and the undulations 30 will be described below. The examples, including the above-described example of FIG. 2A, can appropriately be combined.

Example 1

Figure 2B:
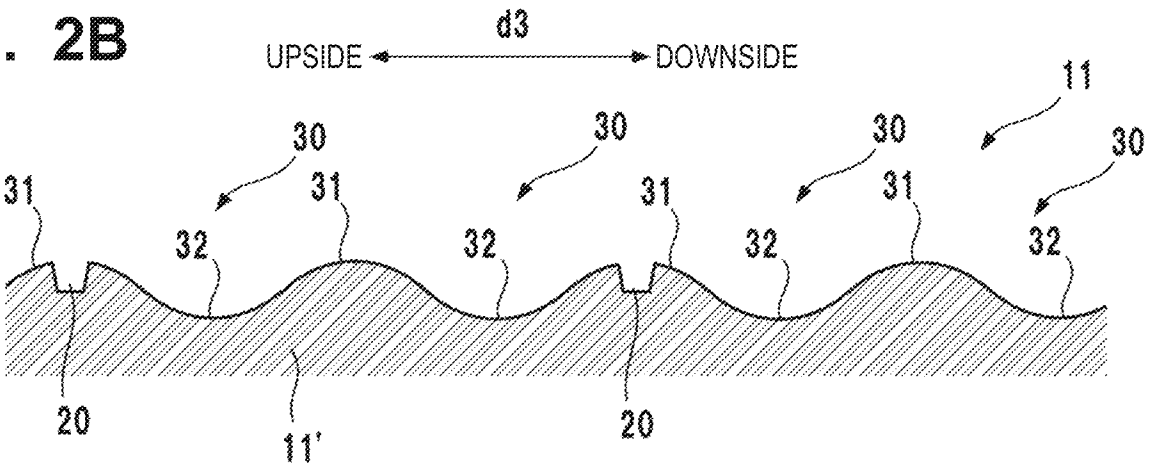
FIG. 2B is an explanatory view of another example.

In the example of FIG. 2A, the score lines 20 are formed in the projecting portions 31. However, there may exist projecting portions 31 without the score lines 20. FIG. 2B shows an example. In the example of FIG. 2B, the projecting portions 31 with the score lines 20 and the projecting portions 31 without the score lines 20 are alternately arranged. In the example of FIG. 2B, the pitch P is ½ the pitch of the score lines 20. In addition, two bottom portions 32 are formed between adjacent score lines 20.

Figure 7A:
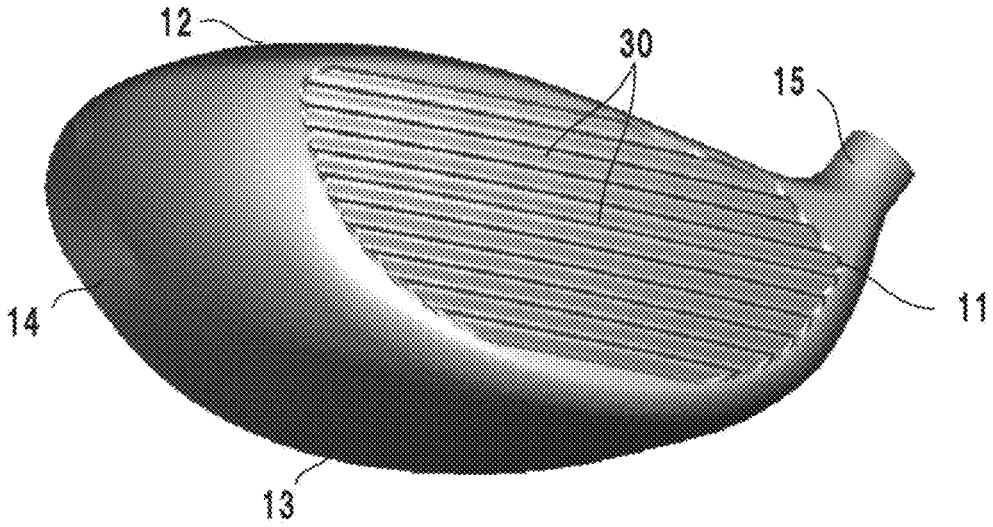
FIGS. 7A and 7B are explanatory views of other examples.
Figure 7B:
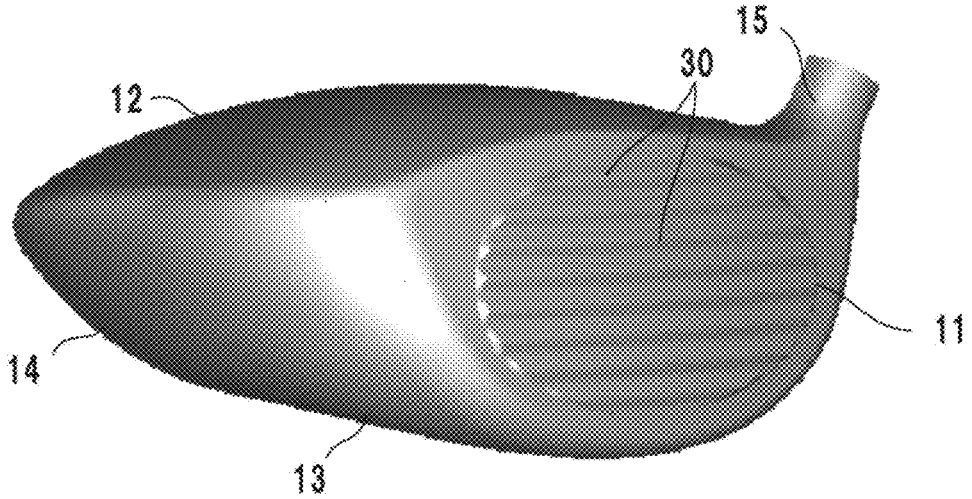

FIGS. 7A and 7B are perspective views of an example in which the score lines 20 are not formed. In the example of FIG. 7A, the undulations 30 are formed all over the face portion 11. In the example of FIG. 7B, the undulations 30 are formed in the impact area of the face portion 11.

Example 2

Figure 3A:
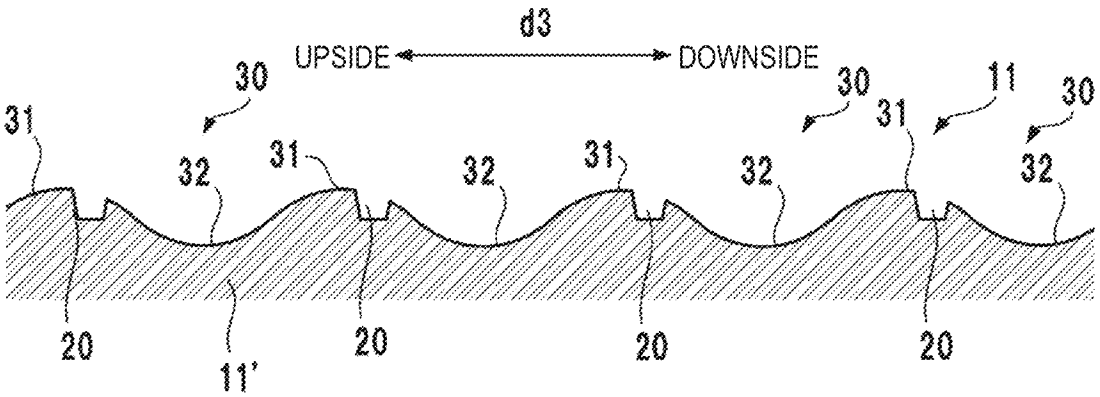
FIGS. 3A to 3C are explanatory views of other examples.

In the example of FIG. 2A, the score lines 20 are formed at the apexes of the projecting portions 31. However, the score lines 20 may be formed at positions shifted from the apexes of the projecting portions 31. FIG. 3A shows an example. The score lines 20 are formed at positions shifted from the apexes of the projecting portions 31.

Example 3

Figure 3B:
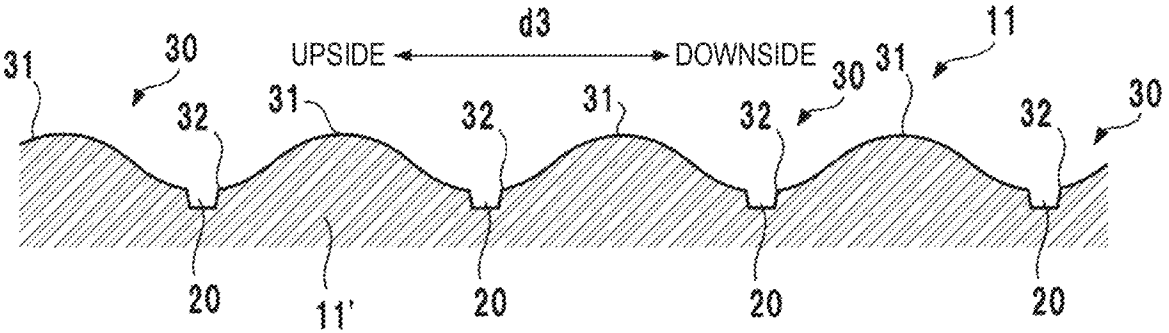

In the example of FIG. 2A, the score lines 20 are formed in the projecting portions 31. However, the score lines 20 may be formed in the bottom portions 32. FIG. 3B shows an example. The score lines 20 are formed at the deepest points of the bottom portions 32. The score lines 20 may be formed at positions shifted from the deepest points.

Example 4

Figure 3C:
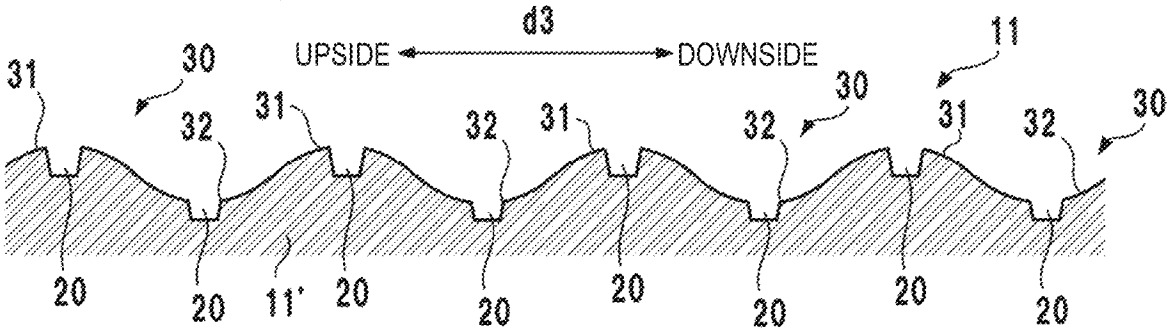

In the example of FIG. 2A, the score lines 20 are formed in the projecting portions 31. However, the score lines 20 may be formed in the bottom portions 32 as well. FIG. 3C shows an example. The score lines 20 are formed at the apexes of the projecting portions 31 and at the deepest points of the bottom portions 32. The score lines 20 may be formed at positions shifted from the apexes of the deepest points.

Example 5

Figure 4A:
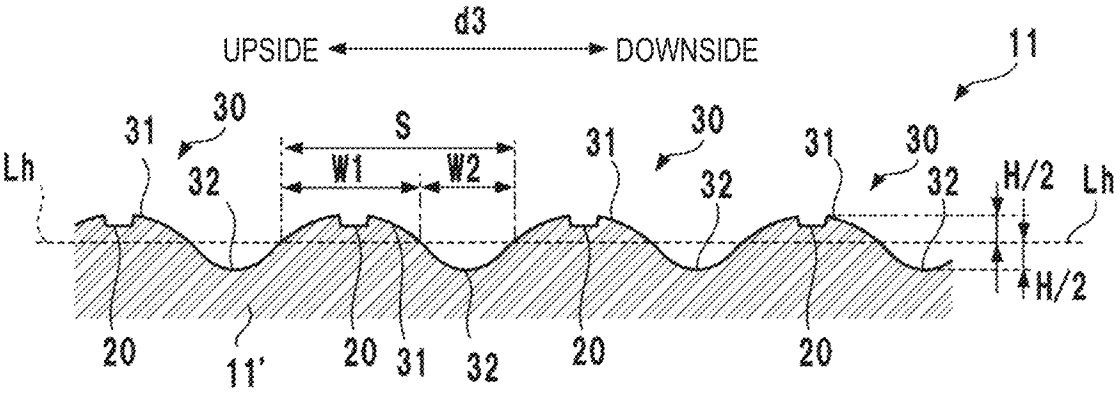
FIGS. 4A and 4B are explanatory views of other examples.

In the example of FIG. 2A, the sectional contour of the undulation 30 has a sine wave shape. However, it may have another S shape. FIG. 4A shows an example. In the undulation 30 of a period S, widths W1 and W2 between intersections of the contour line of the undulation 30 and a line Lh passing through a position at ½ the height H have a relationship W1>W2. That is, the width of the projecting portion 31 in the undulation 30 of one period S is relatively large.

Example 6

In the example of FIG. 2A, the sectional contour of the undulation 30 has an S shape (particularly a sine wave shape).

Figure 4B:
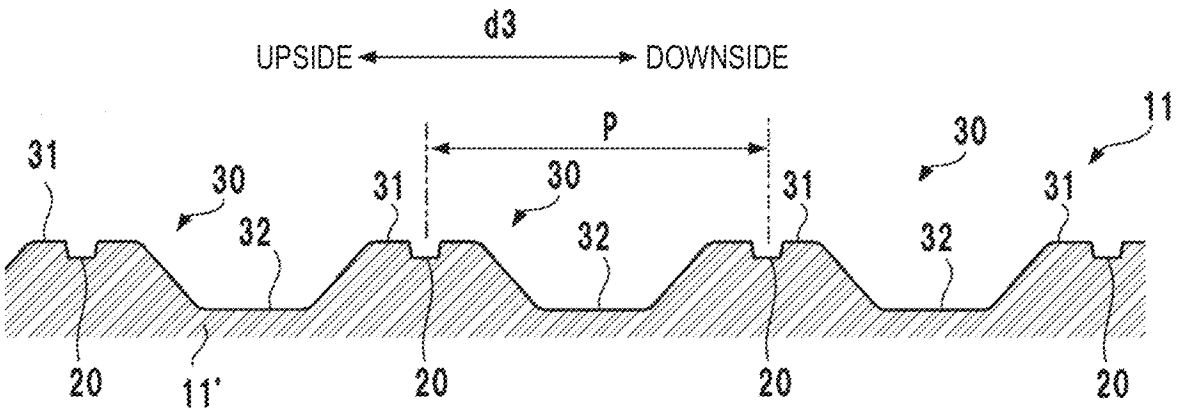

However, it may have a shape other than the S shape. FIG. 4B shows an example. The sectional contour of the undulation 30 has a trapezoidal shape. From the viewpoint of preventing damage to the ball, each corner is preferably rounded. Each corner is preferably rounded in a radius of, for example, 1 mm or less.

Example 7

Figure 5A:
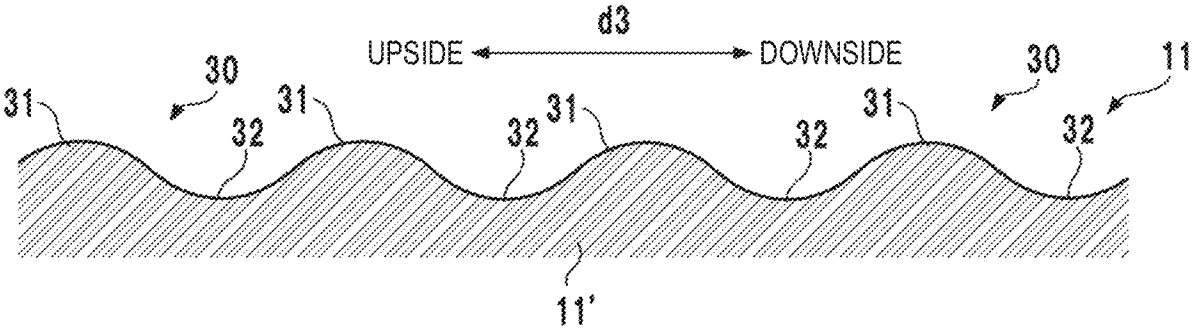
FIGS. 5A and 5B are explanatory views of other examples.

In the example of FIG. 2A, the score lines 20 are provided. However, the score lines 20 may be absent. FIG. 5A shows an example. The face portion 11 has no score lines 20 but only the plurality of undulations 30. As for the surface roughness of the face portion 11, for example, the arithmetic surface roughness Ra is preferably 4 μm or less.

Example 8

Figure 5B:
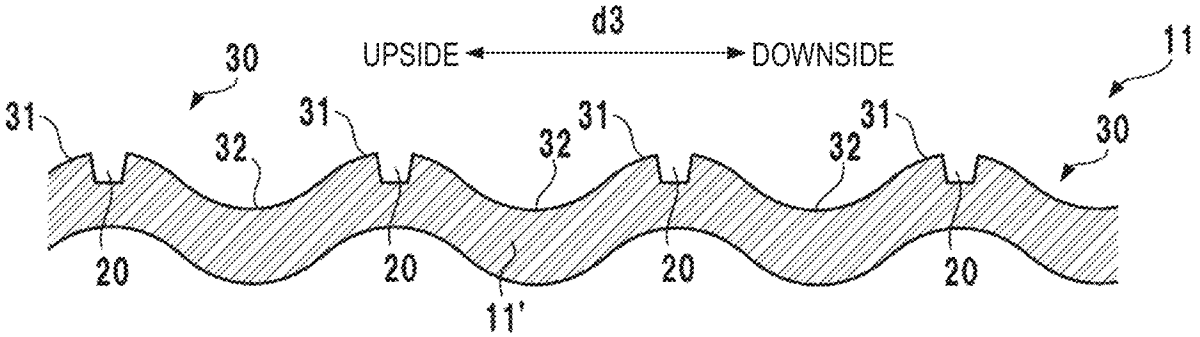

In the example of FIG. 2A, the undulations 30 are formed only on the surface of the metal member 11'. However, the metal member 11' may be bent as a whole, and the undulations 30 may be formed on its surface. FIG. 5B shows an example. In the example of FIG. 5B, the plate-shaped metal member 11' is bent as a whole, thereby forming the undulations 30.

Example 9

Figure 6A:
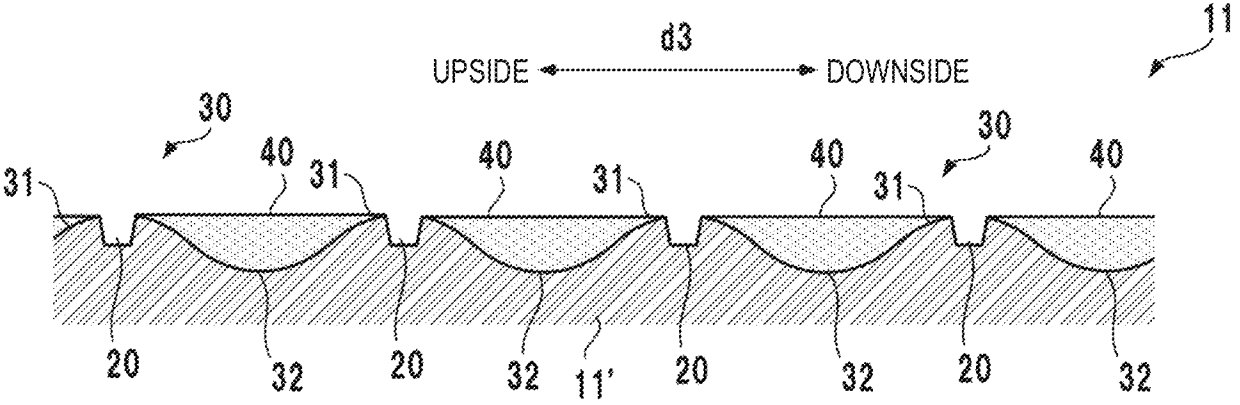
FIGS. 6A and 6B are explanatory views of other examples.

A resin layer may be formed on the surface of the metal member 11'. The resin layer may be able to improve the design of the face portion 11. The resin is, for example, urethane. The resin layer may be formed to flatten the undulations 30. FIG. 6A shows an example.

In the example of FIG. 6A, the undulations 30 are buried in resin layers 40 to smoothen the face portion 11. The score lines 20 are not buried in the resin layers 40 so as to be exposed to the face portion 11. In general, the face portion is smooth, for this reason, the existence of the plurality of undulations 30 may give a golfer a sense of incongruity. When the undulations 30 are buried in the resin layers 40, the sense of incongruity of the golfer can be reduced. Note that at impact, the back spin amount reducing effect of the undulations 30 is maintained by elastic deformation of the resin layers 40.

Figure 6B:
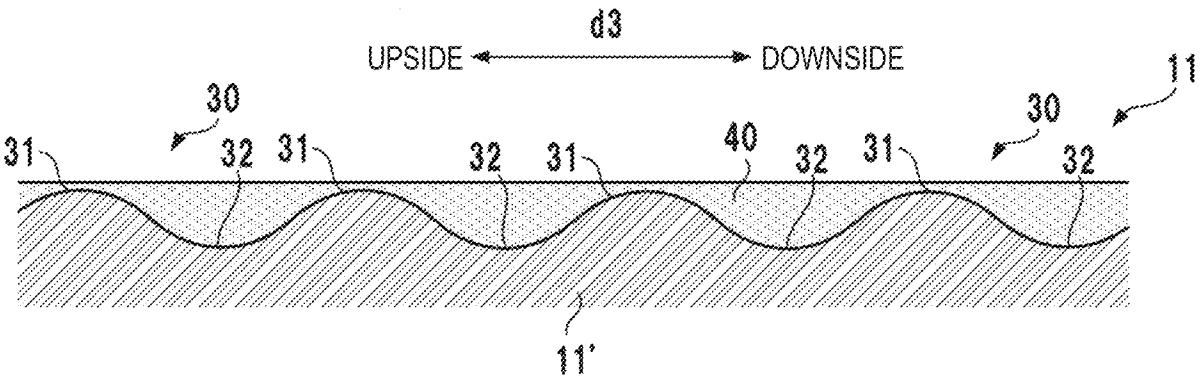

FIG. 6B also shows an example in which a resin layer is formed. In the example of FIG. 6B as well, the undulations 30 are buried in the resin layer 40 to smoothen the face portion 11. In the example of FIG. 6B, the apexes of the projecting portions 31 are also buried in the resin layer 40. The entire surface of the metal member 11' is buried in the resin layer 40 so as not to be exposed. Note that no score lines are provided in the example of FIG. 6B. When score lines are provided, they may be buried in the resin layer 40 as well.

EXAMPLES

Prototypes of golf club heads were made, and evaluation tests of the back spin amount and the like were conducted. FIGS. 8A to 8D show the experimental results.

FIGS. 8A and 8B show results obtained by making a plurality of golf club heads #1 to #4 having different pitches P between the projecting portions 31 and measuring the back spin amount at impact. Golf club heads #1 to #4 are golf club heads for a driver having a loft angle of 11° and have the same specifications except the conditions of the undulations of the face portion. Golf club head #1 is a head having no undulations in the face portion, equivalent to a conventional golf club head. Golf club heads #2 to #4 are heads having undulations in the face portion, in which the pitch P is changed while setting the height H of the projecting portions 31 to the same value (2 mm).

As compared to golf club head #1, golf club head #2 having the pitch P of 3 mm did not produce a large back spin amount reducing effect. The spin amount was larger than in golf club head #1 having no undulations. Golf club head #3 having the pitch P of 5 mm and golf club head #4 having the pitch P of 7 mm had the back spin amount reducing effect. The reducing effect was particularly large in golf club head #3 having the pitch P of 5 mm.

As described above, when the pitch P exceeds 3 mm, the back spin amount reducing effect is produced. Especially when the pitch P is 5 mm (inclusive) to 7 mm (inclusive), a definite back spin amount reducing effect can be obtained.

Note that as for damages to balls after impact, there was no large difference between the golf club heads.

FIGS. 8C and 8D show results obtained by making a plurality of golf club heads #11 to #15 having different heights H of the projecting portions 31 and measuring the back spin amount at impact. Golf club heads #11 to #15 are golf club heads for a driver having a loft angle of 11° and have the same specifications except the conditions of the undulations of the face portion. Golf club head #11 is a head having no undulations in the face portion, equivalent to a conventional golf club head. Golf club heads #12 to #15 are heads having undulations in the face portion, in which the height H is changed while setting the pitch P of the projecting portions 31 to the same value (5 mm).

As compared to golf club head #11, golf club head #12 having the height H of 0.25 mm did not produce a large back spin amount reducing effect. The spin amount was almost the same as in golf club head #11 having no undulations. Golf club heads #13 to #15 each having the height H of 0.50 mm or more had the back spin amount reducing effect. The reducing effect was particularly large in golf club head #15 having the height H of 2.00 mm.

As described above, when the height H is 0.50 mm or more, the back spin amount reducing effect is produced. Especially when the height H is 2.00 mm, a definite back spin amount reducing effect can be obtained. Even when the height H is increased to some extent beyond 2.00 mm, the back spin amount reducing effect is assumed to be produced, although formation of the undulations is more difficult. Hence, the height H is preferably 0.50 mm (inclusive) to 2.00 mm (inclusive).

Note that as for damages to balls after impact, there was no large difference between the golf club heads.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-232566, filed Nov. 8, 2013, which is hereby incorporated by reference herein in its entirety.

What is claimed is:

1. A golf club head including a sole portion and a face portion, comprising: a metal member that forms said face portion, wherein a surface of said metal member comprises: a plurality of score lines; and undulations continuously formed in an up-down direction of said face portion, a pitch between adjacent apexes of said undulations exceeds 3 mm, and said score lines are formed at the apexes of said undulations; wherein one bottom portion of said undulation is located between said score lines that are adjacent.

2. The golf club head according to claim 1, wherein a surface roughness (Ra) of said metal member is not more than 4 μm.

3. The golf club head according to claim 1, wherein the pitch between the adjacent apexes of said undulations is 5 mm (inclusive) to 7 mm (inclusive).

4. The golf club head according to claim 1, wherein a height from a bottom portion of each undulation to the apex is 0.50 mm (inclusive) to 2.00 mm (inclusive).

5. The golf club head according to claim 1, wherein a resin layer is formed on the surface of said metal member.

6. The golf club head according to claim 5, wherein said resin layer is formed to flatten said undulations.

7. The golf club head according to claim 1, wherein a loft angle of said face portion is not more than 20°.

8. A golf club head including a sole portion and a face portion, comprising:

a metal member that forms said face portion, wherein a surface of said metal member comprises:

a plurality of score lines;

undulations continuously formed in an up-down direction of said face portion;

said score lines are formed at the apexes of said undulations;

wherein one bottom portion of said undulation is located between said score lines that are adjacent; and a sectional contour of each undulation has an S shape.

9. The golf club head according to claim 8, wherein the sectional contour of each undulation has a sine wave shape.

10. The golf club head according to claim 8, wherein a pitch between adjacent apexes of said undulations exceeds 3 mm.

11. The golf club head according to claim 8, wherein the pitch between the adjacent apexes of said undulations is 5 mm (inclusive) to 7 mm (inclusive).

12. The golf club head according to claim 8, wherein a height from a bottom portion of each undulation to the apex is 0.50 mm (inclusive) to 2.00 mm (inclusive).

13. The golf club head according to claim 8, wherein a resin layer is formed on the surface of said metal member.

14. The golf club head according to claim 13, wherein said resin layer is formed to flatten said undulations.

15. The golf club head according to claim 8, wherein a loft angle of said face portion is not more than 20°.

* * * * *